US005472078A

United States Patent [19]

Hoffmann et al.

[11] Patent Number: 5,472,078

[45] Date of Patent: Dec. 5, 1995

[54] METHOD OF AND APPARATUS FOR CONVERTING A SINGLE LAYER OF ROD-SHAPED ARTICLES INTO A MASS FLOW

[75] Inventors: Wilfried Hoffmann, Richmond; Gerd Sanmann, Sandston; Joerg Foerster; Peter Trenkner, both of Richmond, all of Va.

[73] Assignee: Hauni Maschinenbau AG, Hamburg, Germany

[21] Appl. No.: 274,968

[22] Filed: Jul. 14, 1994

[51] Int. Cl.[6] ..... B65G 47/26

[52] U.S. Cl. ..... 198/431; 198/426; 198/462.3; 198/572; 198/471.1

[58] Field of Search ..... 198/347.1, 418.6, 198/426, 428, 430, 431, 462, 471.1, 480.1, 572

[56] References Cited

U.S. PATENT DOCUMENTS

| | | | |
|---|---|---|---|
| 3,262,243 | 7/1966 | Molins | 198/426 X |
| 3,664,891 | 5/1972 | Schubert et al. | 198/461 |
| 3,799,324 | 3/1974 | Hall | 198/462 X |
| 4,697,691 | 10/1987 | Zodrow et al. | 198/433 X |
| 4,938,340 | 7/1990 | Horsley et al. | 198/462 |

FOREIGN PATENT DOCUMENTS

| | | | |
|---|---|---|---|
| 2081664 | 2/1982 | United Kingdom | 198/428 |

*Primary Examiner*—James R. Bidwell
*Attorney, Agent, or Firm*—Darby & Darby

[57] ABSTRACT

A single layer of spaced-apart rod-shaped articles of the tobacco processing industry is advanced sideways toward a transfer zone wherein successive groups of two or more neighboring articles are diverted along separate paths against a concave friction surface of an intercepting member. The friction surface directs at least some of the diverted articles into a chamber where the articles are gathered to form a supply of superimposed articles. A belt or chain conveyor is employed to draw a continuous homogeneous mass flow of articles from the chamber.

20 Claims, 2 Drawing Sheets

METHOD OF AND APPARATUS FOR CONVERTING A SINGLE LAYER OF ROD-SHAPED ARTICLES INTO A MASS FLOW

BACKGROUND OF THE INVENTION

The invention relates to improvements in methods of and in apparatus for manipulating rod-shaped articles, such as plain or filter cigarettes, cigars or cigarillos, filter rod sections and/or other rod-shaped articles of the tobacco processing industry. More particularly, the invention relates to improvements in methods of and in apparatus for converting a single layer of spaced-apart parallel elongated rod-shaped articles which are advanced sideways (transversely of their length) into a mass flow containing two or more superimposed layers of parallel articles. The articles of the mass flow can be arrayed in a so-called quincuncial formation.

U.S. Pat. No. 4,938,340 granted Jul. 3, 1990 to Horsley et al. for "Conveying rod-like articles" discloses an apparatus wherein a rotary conveyor delivers a series of successive rod-shaped articles sideways into the relatively narrow inlet of a channel defined by one or more upper endless belt conveyors and one or more lower endless belt conveyors. The width of the channel increases in a direction away from the rotary conveyor so that the articles in the channel can start the formation of a flow wherein some of the articles are contacted by the upper conveyor(s) and the remaining articles are contacted by the lower conveyor(s). The belt conveyors are driven at a speed such that the width of the spaces between successive articles of the single layer is reduced to zero not later than at the discharge end of the aforementioned channel. The latter discharges two superimposed layers of articles into the upper end of a divergent chute which slopes downwardly toward the receiving end of the upper reach of an endless belt conveyor serving to advance a multi-layer mass flow of articles to a filter assembling machine. The chute includes walls which contact the articles of the top layer as well as the articles of the bottom layer.

The patentees propose to accelerate successive articles which leave the rotary conveyor in order to avoid damage from following articles.

Acceleration of articles above the speed which is imparted thereto by the rotary conveyor is likely to result in damage to the articles. Furthermore, each and every article in the aforementioned channel is contacted by at least one belt, and the outer layers of articles in the divergent chute are contacted by fixed parts including a strip of semiflexible material and a so-called deadplate. All this is likely to affect the appearance and/or other desirable characteristics of the conveyed articles.

OBJECTS OF THE INVENTION

An object of the invention is to provide a novel and improved method of converting a single layer of rod-shaped articles into a mass flow of two or more superimposed layers of articles.

Another object of the invention is to provide a method which ensures the formation of a homogeneous mass flow of rod-shaped articles.

A further object of the invention is to provide a method which ensures gentle treatment of rod-shaped articles which form the single layer and which form the mass flow as well of articles which advance from the path for the single layer toward the path for the mass flow.

An additional object of the invention is to provide a novel and improved method of converting a single layer of spaced apart rod-shaped articles of the tobacco processing industry into a mass flow of two or more superimposed layers.

Still another object of the invention is to provide a novel and improved apparatus for the practice of the above outlined method.

A further object of the invention is to provide the apparatus with novel and improved means for converting a single layer of spaced apart rod-shaped articles into a mass flow.

Another object of the invention is to provide the above outlined apparatus with novel and improved means for reducing the kinetic energy of rod-shaped articles between the path for the single layer and the path for the mass flow.

An additional object of the invention is to provide the above outlined apparatus with novel and improved means for defining or establishing paths for advancement of rod-shaped articles away from the path for a single layer of articles.

Still another object of the invention is to provide a machine which embodies or which cooperates with the above outlined apparatus.

SUMMARY OF THE INVENTION

One feature of the present invention resides in the provision of an apparatus for converting a series of successive discrete elongated articles (such as rod-shaped articles of the tobacco processing industry) into a multiple-layer mass flow of superimposed articles. The improved apparatus comprises a first conveyor having means for advancing successive articles of the series transversely of their length (i.e., sideways) along a first path toward a transfer station, means for diverting successive pluralities of articles (e.g., successive groups each of which comprises three articles) of the series arriving at the transfer station into a plurality of different second paths, means for intercepting successive pluralities of diverted articles including an at least partially concave surface extending across one or more second paths and establishing (either alone or in combination with at least one other component of the apparatus) a collecting chamber wherein the intercepted articles gather next to and are superimposed upon each other, and at least one second conveyor having means for withdrawing from the chamber an at least substantially continuous flow of superimposed articles.

The first conveyor can constitute or resemble a drum which is rotatable about an axis extending in at least substantial parallelism with the articles in the first path. The advancing means can include an array of receptacles (e.g., in the form of flutes machined into or otherwise formed in the peripheral surface of the drum) which circulate about the axis of the first conveyor along the first path in response to rotation of the first conveyor. The first path is or can be a partly circular path and at least one of the plurality of different second paths is or can be at least substantially tangential to the partly circular path.

The diverting means can include means for expelling successive pluralities of articles from the first path into the plurality of different second paths. The expelling means is or can be connected to (e.g., made of one piece with) the intercepting means. It is possible to provide the diverting means with a convex surface which merges gradually into the at least partially concave surface.

The apparatus can comprise pneumatic means and/or mechanical means for attracting or for urging the articles of the series of articles to or against the advancing means along the first path.

The withdrawing means of the at least one second conveyor can comprise at least one endless flexible element (e.g., a belt or chain) having an elongated reach which carries the flow of superimposed articles leaving the collecting chamber.

The first conveyor can be disposed at a first level, and the collecting chamber can be disposed at a second level below the first level. The withdrawing means is preferably disposed at a third level at least close to the second level.

The apparatus preferably further comprises a variable-speed prime mower (e.g., an electric motor) for the at least one second conveyor, means for monitoring the frequency of advancement of successive articles of the series along a selected portion of the first path, and means for varying the speed of the prime mover as a function of the monitored frequency.

The at least one partially concave surface can constitute a friction surface which decelerates (i.e., reduces the kinetic energy of) successive pluralities of articles on their way into the collecting chamber.

The apparatus can also comprise means for monitoring the height of the flow of superimposed articles on the at least one second conveyor.

The first conveyor can be provided with a convex surface which extends along the first path, and the diverting means can be provided with a surface which is disposed at the transfer station and establishes for successive pluralities of articles a further path merging into the first path as well as into a path which is defined by the at least partially concave surface.

The advancing means can include suction ports which are provided on the first conveyor.

Another feature of the invention resides in the provision of a method of converting a series of successive discrete elongated rod-shaped articles into a mass flow of superimposed layers of articles. The method comprises the steps of advancing successive articles of the series transversely of their length along a first path toward a transfer station, diverting successive pluralities of articles of the series from the first path into a plurality of different second paths, intercepting successive pluralities of diverted articles including positioning an at least partially concave surface across at least one of the second paths, gathering successive intercepted articles into a supply of superimposed articles, and drawing a continuous mass flow of superimposed articles from the supply.

The first path can include a substantially circular portion and at least one of the plurality of different second paths is or can be at least substantially tangential to the substantially circular portion of the first path.

The second paths are preferably oriented or distributed in such a way that they deliver articles to different portions of the supply.

The at least partially concave surface is positioned and configurated to reduce the kinetic energy of articles arriving along at least one second path. For example, the kinetic energy of articles arriving along the at least one second path can be reduced as a result of frictional engagement with the at least partially concave surface.

The articles can constitute rod-shaped articles of the tobacco processing industry such as plain or filter cigarettes, cigars or cigarillos and/or filter rod sections.

The first path preferably slopes downwardly at the transfer station, the second paths can slope downwardly toward the at least partially concave surface, and the at least partially concave surface can slope downwardly toward the supply of superimposed articles.

The novel features which are considered as characteristic of the method and apparatus are set forth in particular in the appended claims. The improved method itself, however, together with additional features and advantages thereof, will be best understood upon perusal of the following detailed description of certain presently preferred embodiments of the improved apparatus with reference to the accompanying drawings.

DESCRIPTION OF PREFERRED EMBODIMENTS

Figure 1:
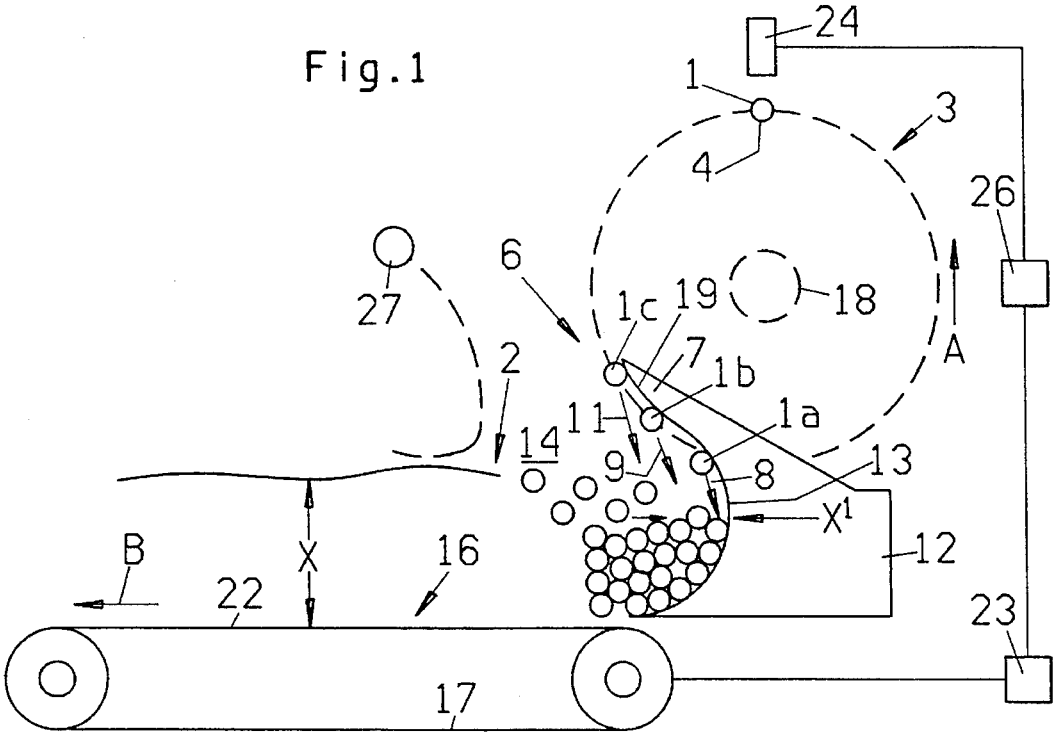
FIG. 1 is a partly schematic side elevational view of an apparatus which can be utilized for the practice of the improved method and embodies one presently preferred form of the invention.

FIG. 1 shows an apparatus which is used to convert a series of successive discrete elongated rod-shaped articles 1 into a continuous mass flow 2. Successive articles 1 of the series are advanced along a circular first path defined by an array of equidistant receptacles or advancing means 4 which orbit about the horizontal axis 18 of a rotary drum-shaped first conveyor 3 when the conveyor is driven to rotate in the direction of arrow A. The illustrated receptacles 4 are elongated flutes which are machined into or otherwise formed in the peripheral surface of the conveyor 3. The articles 1 are advanced sideways, i.e., transversely of their length, along the first path on the conveyor 3 as well during further transport toward and into the mass flow 2.

The flutes 4 advance successive articles 1 of the series of articles in the first path toward a transfer station 6 at which successive pluralities or groups of three articles 1*a*, 1*b*, 1*c* each are diverted into discrete (different or separate) second paths 8, 9 and 11, respectively. At least one of the three-second paths 8, 9 and 11 is at least substantially tangential to the adjacent portion of the first path (extending along the peripheral surface of the conveyor 1).

The articles 1*a* to 1*c* of each successive plurality or group are diverted in part by at least one tongue-like diverting member 7 which extends into a circumferentially complete groove 33 in the peripheral surface of the conveyor 3. The articles 1 which advance at the transfer station 6 move along the adjacent slightly convex surface 19 of the diverting member 7 which prevents the articles from advancing beyond the second path 8 on their way toward the concave friction surface 13 which extends across at least one of the paths 8, 9, 11 and is provided on a stationary intercepting member 12. The illustrated intercepting member is connected to (e.g., of one piece with) the diverting member 7, and its concave surface 13 establishes a collecting chamber 14 which gathers the intercepted and decelerated articles 1 to form a supply of superimposed parallel articles.

The apparatus further comprises a second conveyor 16 including one or more endless flexible elements 17 (such as belts or chains) serving as a means for withdrawing from the supply of superimposed articles 1 in the chamber 14 an at least substantially continuous and uniform mass flow 2 for transport in the direction of arrow B. The mass flow 2 is advanced by the substantially horizontal upper reach or stretch 22 of the endless flexible element 17.

The level of the uppermost layer of parallel articles 1 in the mass flow 2 is monitored by a pivotable sensor lever or arm 27 which can generate signals or which can initiate the generation of signals serving to regulate the ratio of speeds of the conveyors 3 and 16 when the detected level departs from a desired optimum level. In addition to or in lieu of such function, the lever or arm 27 can serve as a means for smoothing the upper side of the mass flow 2 on the conveyor 16.

A further monitoring device 24 (e.g., a photoelectric detector) is installed adjacent a portion of the first path at the twelve o'clock position of the conveyor 3 to vary, at 26, the speed of a variable-speed prime mover 23 for the conveyor 16 when the frequency of advancement of successive articles 1 past the device 24 is too high or too low, for example, when the chamber 14 contains an excessive or an insufficient supply of parallel rod-shaped articles.

The path which is defined by the convex surface 19 of the diverting or deflecting member 7 merges gradually into the first path defined by the conveyor 3 as well as into the additional path which is defined by the concave surface 13 of the intercepting member 12.

It will be noted that, in the illustrated apparatus, the conveyor 3 is located at a first level, that the concave surface 13 is disposed at a second level below the first level, and that the mass flow 2 leaving the chamber 14 is located at a third level which is close to or coincides with the second level. The first path which is defined by the conveyor 3 slopes downwardly toward the transfer station 6, the second paths 8, 9 and 11 slope downwardly toward the concave surface 13, and the surface 13 slopes downwardly toward the level of the upper reach 22 of the endless flexible element 17 of the conveyor 16.

The aforedescribed staggered transfer of pluralities of articles (1*a*, 1*b*, 1*c*) along different second paths 8, 9 and 11 ensures that the diverted articles 1 are spread out or fanned out into different portions of the chamber 14, i.e., into different portions of the supply of superimposed articles 1 in the chamber. Such mode of feeding articles into the chamber 14 ensures the formation of a homogeneous supply of articles upstream of the upper reach 22 of the element 17 so that the latter can draw a homogeneous mass flow 2 toward a processing station, e.g., into a filter tipping machine if the articles 1 are plain cigarettes, cigars or cigarillos or filter rod sections of unit length or multiple unit length.

The concave surface 13 is or can constitute a friction surface which reduces the kinetic energy of articles 1 coming in direct contact with the intercepting member 12. The concave surface 13 cooperates with the surface 19 and with the pneumatic system in the conveyor 3 to ensure that the diverted articles as well as the diverted and intercepted articles penetrate into the lower strata of the articles which form the supply of superimposed parallel articles in the chamber 14. The height $X^1$ of the supply of articles 1 in the chamber 14 adjacent the concave surface 13 can equal or at least approximate the height X of the mass flow 2 on the upper reach 22 of the endless flexible element 17 forming part of the second conveyor 16. The articles (1*c*) advancing along the leftmost second path 11 are directed into a loose zone within the chamber 14, namely into a zone to the left of the layers of articles (1*a*, 1*b*) which were caused to advance along the paths 8 and 9 directly along the concave surface 13. The loose zone in the chamber 14 can be said to constitute a wave hole and is desirable because this ensures the formation of a supply of parallel articles 1 having a height which is sufficient to enable the conveyor 16 to withdraw from the chamber 14 an at least substantially uniform or homogeneous mass flow 2 having the desired height X.

Figure 2:
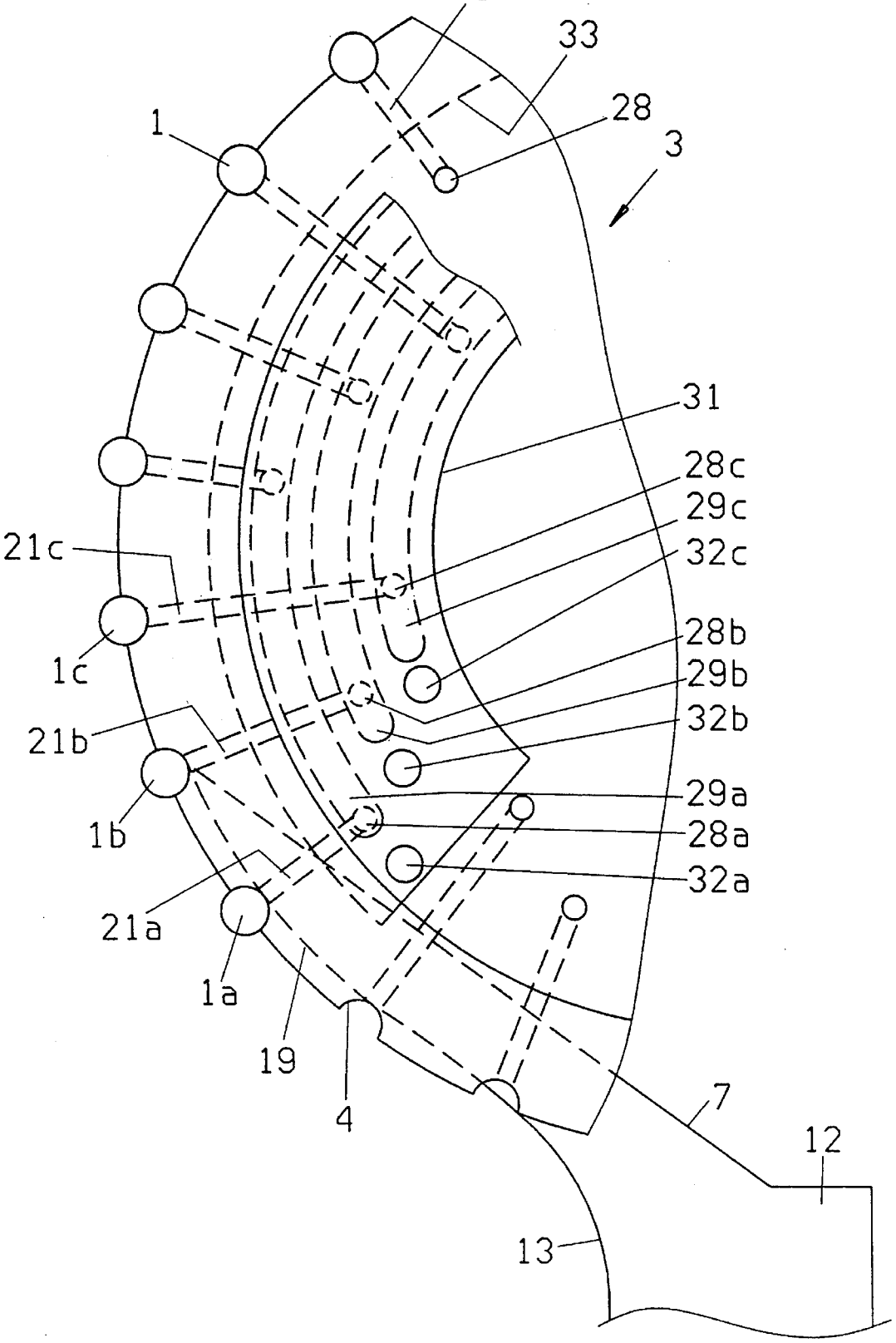
FIG. 2 is an enlarged view of a detail in the apparatus of FIG. 1, showing the construction of the first conveyor and of the member which diverts successive pluralities of rod-shaped articles from the advancing means of the first conveyor toward the concave surface of the intercepting member.

FIG. 2 illustrates the manner in which the conveyor 3 establishes several second paths 8, 9 and 11 which make oblique angles with each other, and the manner in which the conveyor 3 cooperates with the member 12 to ensure the aforediscussed reduction of kinetic energy of articles 1 advancing toward and into the chamber 14. Each flute 4 of the conveyor 3 is provided with at least one suction port 21 which, in turn, communicates with one of three axially parallel channels 28 provided in the body of the conveyor 3. Each channel 28 extends to one end face of the conveyor 3 and communicates, during a predetermined part of each revolution of the conveyor 3, with one of three arcuate suction channels or grooves, 29*a*, 29*b*, 29*c* provided in a stationary valve plate 31. The grooved or channeled side of the valve plate 31 is in sealing engagement with the adjacent end face of the conveyor 3.

Three successive suction ports 21*a*, 21*b*, 21*c* in the body of the conveyor 3 communicate with three different grooves 29*a*, 29*b*, 29*c* of the valve plate 31, at least while the articles 1 are caused to advance along that portion of their first path which is adjacent the transfer station 6. This ensures that the article 1*c* of each plurality or group of articles is no longer attracted to the surface bounding the respective flute 4 and advances along the path 11 while the articles 1*b*, 1*c* continue to be held in their flutes by suction, and that the article 1*a* of each plurality or group of articles continues to be attracted to the conveyor 3 while the preceding article 1*b* is already in the process of advancing along its path 9.

The valve plate 31 is further provided with staggered aerating holes or bores 32*a*, 32*b*, 32*c* which respectively admit air into the oncoming channels 28*a*, 28*b*, 28*c* to thus ensure that the articles 1*a*, 1*b*, 1*c* of successive pluralities or groups are no longer attracted to the conveyor 3 so that they are even more likely to enter the respective paths 8, 9 and 11, namely with assistance from centrifugal force.

The manner in which a rotary drum-shaped conveyor can pneumatically attract rod-shaped articles during advancement along an arcuate path is fully disclosed and shown, for example, in U.S. Pat. No. 3,664,891 granted May 23, 1972 to Schubert et al. for "Apparatus for assembling rows of rod-shaped articles". To the extent that it contributes to the understanding of the present invention, the disclosure of the patent to Schubert et al. is incorporated herein by reference.

The conveyor 3 can form part of or can receive rod-shaped articles from a cigarette rod making machine such as the cigarette maker known as PROTOS. Alternatively, the conveyor 3 can form part of or can receive rod-shaped articles from a filter tipping machine, e.g., a machine known as MAX, or from a filter rod making machine such as that known as KDF.

The conveyor 16 can deliver the mass flow 2 to a packing machine, e.g., a machine known as COMPAS, by way of a transfer system of the type known as RESY or of the type known as COMFLEX. Alternatively, the conveyor 16 can be utilized to deliver a mass flow of filter rod sections to a feeding system such as that known as FILTROMAT.

The aforementioned machines (PROTOS, MAX, KDF and COMPAS) as well as the aforementioned systems (RESY, COMFLEX and FILTROMAT) are distributed by the assignee of the present application.

An important advantage of the improved method and apparatus is that one can dispense with a top belt, such as that shown in U.S. Pat. No. 4,938,340, for reliable conversion of a single layer of spaced-apart discrete rod-shaped articles into a homogeneous mass flow. Furthermore, the improved apparatus is simple and compact and does not affect the quality of articles on their way from the conveyor 3 onto the conveyor 16. Still further, the concave surface 13 reduces the kinetic energy of oncoming articles to such an extent that the articles continue to move transversely of their length and form a stack of parallel articles in the chamber 14 at the receiving end of the upper reach 22 of the endless flexible element 17. Moreover, the speed of the conveyor 16 can be accurately synchronized with the speed of the conveyor 3 (to produce a mass flow 2 of desired height) in a simple and inexpensive but reliable manner.

The number of second paths can be reduced to less than three or increased to more than three without departing from the spirit of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for converting a series of successive discrete elongated rod-shaped articles into a mass flow of superimposed articles, comprising a first conveyor having means for advancing successive articles of the series transversely of their length along a first path toward a transfer station, said first conveyor being rotatable about an axis which is at least substantially parallel to the articles in said first path and said advancing means including an array of receptacles circulating about said axis along said first path in response to rotation of said first conveyor; means for diverting successive pluralities of articles of the series arriving at said station into a plurality of different second paths; means for intercepting successive pluralities of diverted articles including an at least partially concave surface extending across at least one of said second paths and establishing a collecting chamber wherein the intercepted articles gather next to and are superimposed upon each other; and at least one second conveyor having means for withdrawing from the chamber an at least substantially continuous flow of superimposed articles.

2. The apparatus of claim 1, wherein said first path is a partly circular path and at least one of said different second paths is at least substantially tangential to said partly circular path.

3. Apparatus for converting a series of successive discrete elongated rod-shaped articles into a mass flow of superimposed articles, comprising a first conveyor having means for advancing successive articles of the series transversely of their length along a first path toward a transfer station; means for diverting the articles of successive pluralities of articles of the series arriving at said station into a plurality of different second paths; means for intercepting successive pluralities of diverted articles including an at least partially concave surface extending across at least one of said second paths and establishing a collecting chamber wherein the intercepted articles gather next to and are superimposed upon each other; and at least one second conveyor having means for withdrawing from the chamber an at least substantially continuous flow of superimposed articles.

4. The apparatus of claim 3, wherein said diverting means includes means for effecting the expulsion of successive pluralities of articles from said first path into said plurality of different second paths.

5. The apparatus of claim 4, wherein said diverting means includes a portion which is connected with said intercepting means.

6. The apparatus of claim 3, wherein said diverting means includes a convex surface merging into said at least partially concave surface.

7. The apparatus of claim 3, wherein said diverting means comprises means for pneumatically attracting the articles of said series to the advancing means only along said first path.

8. The apparatus of claim 7, wherein said means for pneumatically attracting the articles includes suction ports provided in said advancing means and means for withdrawing air from said ports during different stages of advancement of successive articles along said first path so that each article of a plurality of articles is released into the respective second path from a different portion of said first path.

9. The apparatus of claim 3, wherein said first conveyor is disposed at a first level and said chamber is located at a second level beneath said first level, said withdrawing means being disposed at a third level at least close to said second level.

10. The apparatus of claim 3, further comprising a variable-speed prime mover for said at least one second conveyor, means for monitoring the frequency of advancement of successive articles of the series along a portion of said first path, and means for varying the speed of said prime mover as a function of the monitored frequency.

11. The apparatus of claim 3, wherein said at least partially concave surface is a friction surface which decelerates at least one article of each plurality of articles while the at least one article advances into said chamber.

12. The apparatus of claim 3, further comprising means for monitoring the height of said flow on said at least one second conveyor.

13. The apparatus of claim 3, wherein said first conveyor has a convex peripheral surface extending along said first path and said diverting means has a surface disposed at said station and establishing for at least one article of each of said pluralities of articles a further path merging gradually into said first path and into a path defined by said at least partially concave surface.

14. The apparatus of claim 3, wherein said advancing means includes suction ports provided in said first conveyor.

15. A method of converting a series of successive discrete elongated rod-shaped articles into a mass flow of superimposed articles, comprising the steps of advancing successive articles of the series transversely of their length toward a transfer station along a first path including a substantially circular portion; diverting successive pluralities of articles of the series from the first path into a plurality of different second paths at least one of which is at least substantially tangential to the circular portion of the first path; intercepting successive pluralities of diverted articles including positioning an at least partially concave surface across at least one of the second paths; gathering successive intercepted articles into a supply of superimposed articles; and drawing a continuous mass flow of superimposed articles from the supply.

16. A method of converting a series of successive discrete elongated rod-shaped articles into a mass flow of superimposed articles, comprising the steps of advancing successive articles of the series transversely of their length along a first path toward a transfer station; diverting the articles of successive pluralities of articles of the series from the first path into a plurality of different second paths; intercepting successive pluralities of diverted articles including positioning an at least partially concave surface across at least one of the second paths; gathering successive intercepted articles into a supply of superimposed articles; and drawing a continuous mass flow of superimposed articles from the supply.

17. The method of claim 16, wherein said second paths are oriented to deliver articles to different portions of the supply.

18. The method of claim 16, wherein the at least partially concave surface is configurated and positioned to reduce the kinetic energy of at least some of the articles arriving along said second paths as a result of frictional engagement between the at least partially concave surface and the articles.

19. The method of claim 16, wherein the articles are rod-shaped articles of the tobacco processing industry.

20. The method of claim 16, wherein said first path slopes downwardly at said transfer station, wherein said second paths slope downwardly toward the at least partially concave surface, and wherein the at least partially concave surface slopes downwardly toward the supply of superimposed articles.

* * * * *